US008058789B2

(12) United States Patent
Hunt et al.

(10) Patent No.: US 8,058,789 B2
(45) Date of Patent: Nov. 15, 2011

(54) CATHODOLUMINESCENT PHOSPHOR LAMP HAVING EXTRACTION AND DIFFUSING GRIDS AND BASE FOR ATTACHMENT TO STANDARD LIGHTING FIXTURES

(75) Inventors: Charles E. Hunt, Davis, CA (US); Bernard K. Vancil, Beaverton, OR (US); Richard N. Herring, Longmont, CO (US); Richard Gale Sellers, Seattle, WA (US)

(73) Assignee: Vu1 Corporation, Seattle, WA (US)

( * ) Notice: Subject to any disclaimer, the term of this patent is extended or adjusted under 35 U.S.C. 154(b) by 177 days.

(21) Appl. No.: 11/969,831

(22) Filed: Jan. 4, 2008

(65) Prior Publication Data

US 2008/0185953 A1 Aug. 7, 2008

Related U.S. Application Data

(60) Provisional application No. 60/888,187, filed on Feb. 5, 2007.

(51) Int. Cl.
*H01J 31/48* (2006.01)

(52) U.S. Cl. ..... 313/396; 313/293

(58) Field of Classification Search ..... 313/293, 313/310, 296, 297, 107.5, 495, 496, 449, 313/396

See application file for complete search history.

(56) References Cited

U.S. PATENT DOCUMENTS 4,129,801 A * 12/1978 Soeno et al. ..... 313/346 R
4,160,187 A * 7/1979 Say et al. ..... 313/408
4,340,839 A * 7/1982 Fujita et al. ..... 313/466
4,352,043 A * 9/1982 Rigden ..... 315/1
4,388,551 A * 6/1983 Ray ..... 313/346 R
4,506,191 A 3/1985 Takenobu
4,818,914 A * 4/1989 Brodie ..... 315/169.3
5,254,905 A * 10/1993 Dunbar et al. ..... 313/495
5,552,659 A 9/1996 Macaulay et al.
5,656,887 A 8/1997 Voshell et al.
5,820,921 A * 10/1998 Kawase et al. ..... 427/64
5,821,683 A * 10/1998 Joo et al. ..... 313/346 R
5,831,379 A * 11/1998 Jeong et al. ..... 313/346 DC
5,965,977 A 10/1999 Makishima
5,986,399 A 11/1999 Van Veen et al.
6,081,246 A 6/2000 Cathey et al.
6,091,187 A * 7/2000 Golladay et al. ..... 313/310
6,268,691 B1 7/2001 Takemura et al.

(Continued)

FOREIGN PATENT DOCUMENTS

EP 0035828 A 9/1981

(Continued)

OTHER PUBLICATIONS

International Search Report and Written Opinion issued in related PCT Patent Application Serial No. PCT/US2008/053094, 16 pages, Jun. 6, 2008.

(Continued)

*Primary Examiner* — Nimeshkumar Patel
*Assistant Examiner* — Glenn Zimmerman
(74) *Attorney, Agent, or Firm* — Lathrop & Gage LLP

(57) ABSTRACT

A light emitting device has a cathode-ray tube and power supply. The cathode-ray tube in an embodiment is optimized for emitting a broad electron beam, in one variation a dome-shaped diffusing grid is used to spread the beam. In another embodiment, the device has a base adapted for attachment to a standard lighting fixture.

14 Claims, 11 Drawing Sheets

U.S. PATENT DOCUMENTS

| | | | | |
|---|---|---|---|---|
| 6,354,898 | B2 | 3/2002 | Kim | |
| 6,354,989 | B1 | 3/2002 | Nudeshima | |
| 6,404,136 | B1 | 6/2002 | Murray et al. | |
| 6,504,311 | B1 | 1/2003 | Kumar et al. | |
| 6,604,972 | B1 * | 8/2003 | Yamano | 445/24 |
| 6,614,149 | B2 | 9/2003 | Kastalsky et al. | |
| 6,703,777 | B2 * | 3/2004 | Nakamura et al. | 313/446 |
| 2003/0011292 | A1 * | 1/2003 | Espinosa | 313/311 |
| 2004/0021408 | A1 * | 2/2004 | Wort et al. | 313/346 R |
| 2004/0070329 | A1 * | 4/2004 | Matsukiyo et al. | 313/467 |
| 2005/0156506 | A1 | 7/2005 | Chung et al. | |
| 2005/0179398 | A1 * | 8/2005 | Onishi | 315/169.2 |

FOREIGN PATENT DOCUMENTS

| | | | |
|---|---|---|---|
| EP | 0599202 | A | 6/1994 |
| GB | 2070849 | A | 9/1981 |
| GB | 2097181 | A | 10/1982 |
| WO | 2006066111 | A | 6/2006 |

OTHER PUBLICATIONS

International Search Report and Written Opinion issued in related PCT Patent Application Serial No. PCT/US2008/053100, 17 Pages, Aug. 4, 2008.

International Search Report and Written Opinion issued in related PCT Patent Application Serial No. PCT/US2005/45713, 12 pages, Jun. 12, 2008.

Office Action issued in related U.S. Appl. No. 11/684,303, 15 pages, Jun. 11, 2008.

* cited by examiner

CATHODOLUMINESCENT PHOSPHOR LAMP HAVING EXTRACTION AND DIFFUSING GRIDS AND BASE FOR ATTACHMENT TO STANDARD LIGHTING FIXTURES

RELATED APPLICATIONS

This application claims priority from U.S. Provisional Patent Application 60/888,187 filed 5 Feb. 2007. This application is related to the material of copending, cofiled U.S. patent application Ser. No. 11/696,840, filed Jan. 4, 2008, entitled System and Apparatus for Cathodoluminescent Lighting, which provides power and control functions.

FIELD

The present document relates to the field of light-emitting devices. In particular, the document relates to a device that employs a phosphor stimulated by a defocused electron beam to emit light.

BACKGROUND

A lamp for general lighting (GL) may take many forms as defined by the Illuminating Engineering Society (IES) of North America. The IES provides designations for lamps such as R-Lamp, A-Lamp and PAR-Lamp. Typically, these lamps utilize a tungsten filament that is heated to generate light. This process, however, is inefficient because a significant amount of energy is transferred to the environment in the form of extraneous heat, infrared and ultraviolet radiation. Where these lamps can be fluorescent, they are more efficient but have inferior color rendering and various operation and appearance-related problems.

DETAILED DESCRIPTION OF THE EMBODIMENTS

In accord with the teachings hereinbelow, Cathodoluminescent (CL) phosphors of a general lighting (GL) lamp are excited by a thermionic electron gun to produce light. This device is thus hereinafter referred to as a Cathodoluminescent Phosphor Lamp (CLPL).

Figure 1:
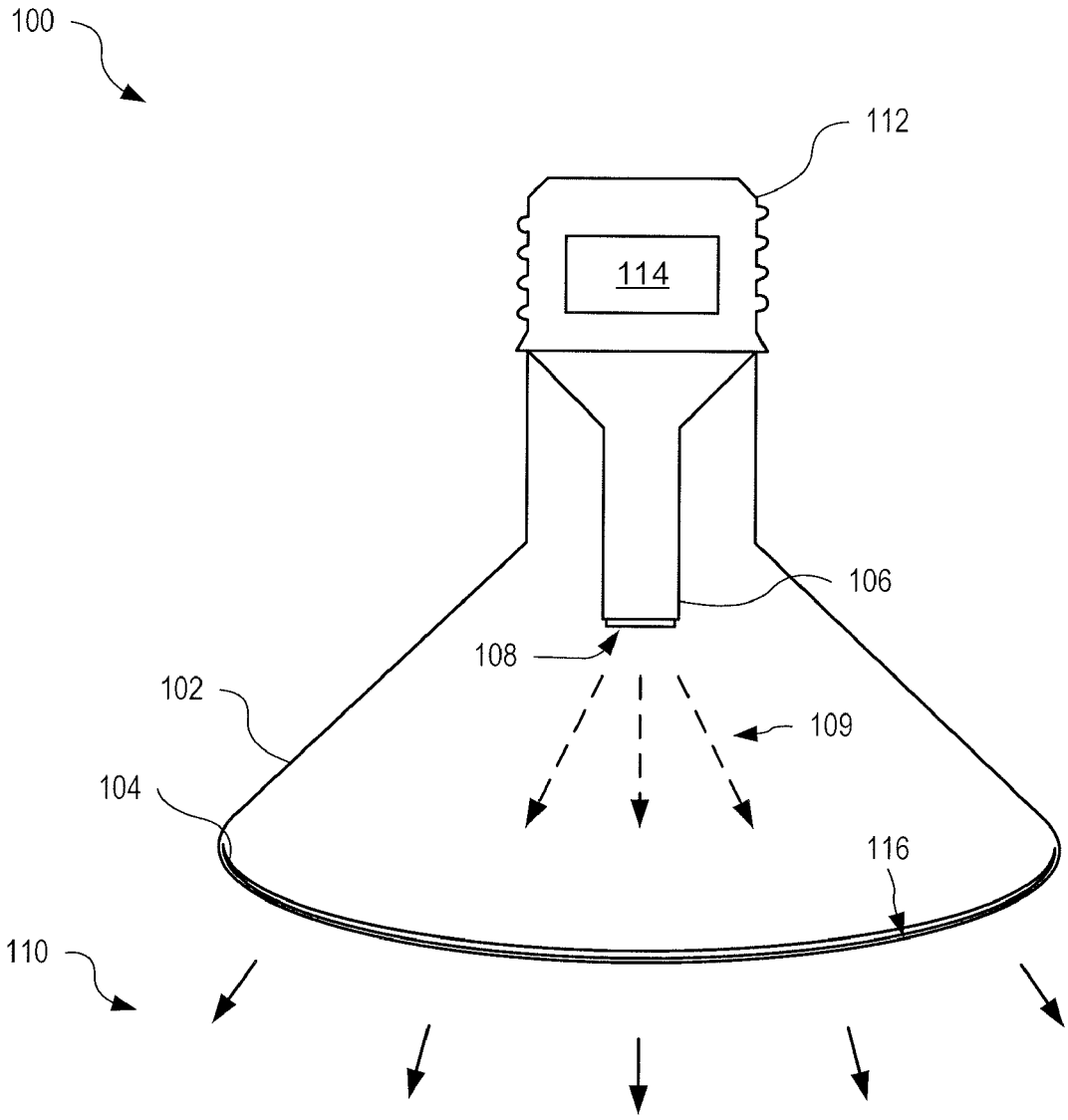
FIG. 1 shows a cross section through one exemplary embodiment of a Cathodoluminescent Phosphor Lamp (CLPL).

FIG. 1 shows a cross section through one exemplary embodiment of a CLPL 100. CLPL 100 is shown with a glass envelope 102, a CL phosphor 104, a thermionic cathode electron gun assembly 106 (that includes an emissive cathode surface 108), and a base assembly 112. Glass envelope 102 and thermionic cathode electron gun assembly 106 form a vacuum containment unit in CLPL 100. Glass envelope 102 may sometimes be referred to as a "jug" herein. CL phosphor 104 may be applied only to an interior of a front surface 116 of glass envelope 102 through which light is emitted. Front surface 116 may also be referred to as light emitting surface 116, hereafter. Although light emitting surface 116 is shown curved in FIG. 1, light emitting surface 116 may conform to any desired topology, including flat. Base assembly 112 includes a power supply 114 and connector such that CLPL 100 is attachable to a suitable available power source such as an alternating current (115V 60 Hz USA or 220V 50 Hz Europe/Asia) household GL lighting fixture (not shown). Power supply 114 includes electronic components for driving electron gun assembly 106 to generate electrons 109 that are directed towards CL phosphor 104; upon impact of electrons 109 with CL phosphor 104, illumination 110 is produced.

Although emissive cathode surface 108 of electron gun assembly 106 is disclosed herein as heated, emissive cathode surface 108 may alternatively be a cold cathode (e.g., field emitter, etc.) without departing from the scope hereof. Where emissive cathode surface 108 operates as a cold cathode, a heater and its associated circuitry is not required.

Although CLPL 100 is shown in the shape of a GL R-30 lamp, it may be configured instead so that its shape conforms to a GL R-Lamp, GL A-Lamp, GL PAR-Lamp, or other shape, without departing from the scope hereof.

Manufacturing Processes

Glass Envelope

Figure 2:
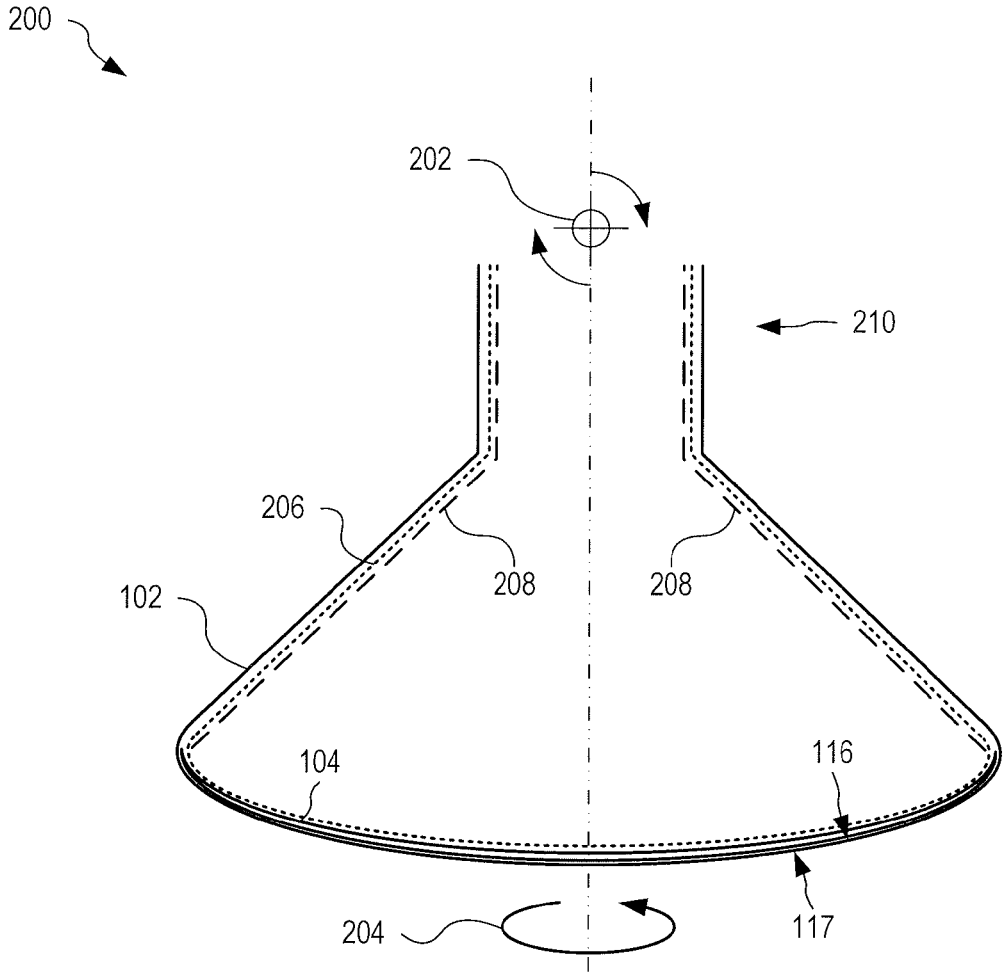
FIG. 2 shows a cross section through a glass envelope assembly, illustrating, in further exemplary detail, the glass envelope and CL phosphor of FIG. 1.

In an embodiment, CLPL 100 is provided with a uniform coating of CL phosphor 104 onto faceplate surface 116 of glass envelope 102, In some embodiments, the CL phosphor 104 is densified after initial deposition to ensure maximal thermal dissipation. The CL phosphor 104 is placed to ensure efficiency and utility. The CL phosphor 104 may be smoothed and lacquered as known in the art of cathode ray display tubes to level the phosphor to allow better reflectivity of later-applied reflective coatings and to prevent later-deposited conductive and reflective coatings from diffusing into the phosphor. FIG. 2 shows a cross section through a glass envelope assembly 200 illustrating, in further exemplary detail, glass envelope 102 and CL phosphor 104 of FIG. 1. In the illustrated embodiment of FIG. 2, glass envelope 102 is longitudinally symmetrical and formed of a single piece of silicate glass that is transmissive in the visible part of the luminous spectrum (e.g., about 400-800 nm). Glass envelope 102 is formed to fit within IES-standard GL lighting fixtures in this example. An internal concave surface 116 of glass envelope 102 is coated with CL phosphor 104, which generates white light of any color temperature or monochromatic light (e.g., bug light, grow light, or mood light). CL phosphor 104 operates as an "anode" within CLPL 100, that is, electrons emitted from the cathode terminate their transit across the vacuum contained by glass envelope 102 within the phosphor. CL phosphor 104 may be selected to be of appropriate brightness for GL applications for scotopic illumination (typically 50-80,000 Cd/m$^2$). The thickness of CL phosphor 104 is based upon electron energy produced by electron gun assembly 106, FIG. 1, and the anode-cathode acceleration potential. CL phosphor 104 is for example applied to surface 116 by one or more methods such as settling, screen printing, electrophoretic cathodic deposition, photo-sensitive printing, spin-coating, etc. CL phosphor 104 may be subsequently densified to maximize thermal conductivity between the CL phosphor 104 and glass envelope 102, thereby maximizing efficiency and lifetime of CLPL 100. In an example of densification, glass envelope 102 is rotated around axis 202 (during manufacture) to apply a centrifugal force to CL phosphor 104, which causes particles of CL phosphor 104 to migrate towards surface 116, increasing density of CL phosphor 104. In alternative embodiments, glass envelope 102 is rotated about other axes, including axis 202 and other axes such as axis 204, to apply centrifugal force to CL phosphor 104. Densification may be accomplished by other means, such as applied pressure or electrostatic attraction or other techniques.

CL phosphor 104 is then coated with a conductive coating 206 that may cover CL phosphor 104 and other internal surfaces of glass envelope 102 to the base end 210. Conductive coating 206 provides electrical contact to CL phosphor 104. Conductive coating 206 may be a transparent conductive layer. Further, interior surfaces of glass envelope 102 that are not coated with CL phosphor 104 may (according to lamp form, R-Lamp, A-Lamp, PAR-Lamp, etc.) be coated with a reflective material 208; this reflective material 208 is a conductive, reflective, metal such as aluminum. In one embodiment, conductive coating 206 may be omitted since reflective material 208 is conductive and can serve as a conductive backing to the phosphor layer. Where reflective material 208 operates to provide electrical contact to CL phosphor 104, CL phosphor layer 104 may first be coated with a leveling or lacquering layer (not shown) that levels the phosphor and causes reflective material 208 to be specular. This leveling layer may be a lacquer with appropriate additives as known in the art of CRT display tubes.

In an embodiment, reflective material 208 is preferably a layer of aluminum less than 0.09 micron thick, and preferably is approximately 0.07 micron thick in areas adjacent to the CL phosphor 104, and no underlying conductive coating 206 is used; this layer is substantially thinner than layers typically used in the art of CRT display tubes. Thin layers have been found to enhance efficiency by absorbing fewer electrons enroute to activate the phosphor. In areas of the envelope not covered by CL phosphor, reflective material 208 may be thicker.

The thickness of CL phosphor 104 is chosen to maximize efficacy of the phosphor, the lifetime of the phosphor, the thermal conductivity of the phosphor, as well as minimize cost and maximize the lifetime of CLPL 100. The thickness of CL phosphor 104 also assures that the glass will not become discolored by directly impacting electrons emitted by electron gun assembly 106. The density of CL phosphor 104 is also obtained in order to maximize the dissipation of heat generated during luminescence of CL phosphor 104 (i.e., when CLPL 100 is operating to produce light). The physical location of CL phosphor 104 within glass envelope 102 is obtained to maximize energy efficiency and luminous flux within a lighting fixture containing CLPL 100.

There are at least five methods known in the art for coating cathode ray tube faces with phosphor, including, (1) settling process, (2) spin-coating process, (3) screen printing process, (4) photo-activated resin process, and (5) electrophoretic deposition process. Through at least one of these processes a CL phosphor coating 104 is deposited in the tube that meets the above requirements for CLPL 100, including: thickness of CL phosphor 104, density of CL phosphor 104 and location of CL phosphor 104.

In an embodiment, the phosphor coating has 0.47 milligram of phosphors per square centimeter, resulting in a coating approximately 15 microns thick; and is preferably less than 20 microns thick. This is thinner than the CL phosphor layer typically used in cathode-ray tubes.

Referring to settling process (1), this process utilizes gravity to settle CL phosphor particles out of a phosphor slurry including at least a silicate or other binder and CL phosphor. This process is modified as follows. First, the curved shape of glass envelope 102 is accommodated by rotating glass envelope 102 around a longitudinal axis 204 during the settling process. Excess slurry is removed from within glass envelope 102. The settled CL phosphor may be insufficiently dense for optimal operation of CLPL 100 and therefore the freshly-settled CL phosphor layer may be densified by centrifugal force along the axial direction (e.g., by rotating glass envelope 102 around axis 202). In alternative embodiments, the freshly-settled CL phosphor layer is densified by centrifugal force by rotating the envelope 102 about additional axes such as axis 204 in addition to axis 202. After densification, the binder is bonded by baking. Ensuing lacquering and coating with reflective, conductive metal, such as aluminization, techniques may then be performed as used in conventional information display fabrication.

Referring to the spin-coating process (2), which normally is used on flat-faced substrates, it is modified so that it may be utilized on surface 116 by spinning about longitudinal axis 204. In alternative embodiments, the envelope 102 is simultaneously spun about additional axes such as axis 204 in addition to axis 202 to increase uniformity of deposition. A predetermined amount of the phosphor slurry is deposited at the center of surface 116; glass envelope 102 is then spun about axis 204. The speed of spinning is changed as the slurry creeps up the concave interior surface 116, thereby changing the deposition rate. With judicial selection of the spin speed (based upon the shape of surface 116, for example), as well as the acceleration or deceleration over time, the deposit is confined to the desired location and is essentially uniform in thickness. If required or desired, the deposit may be densified by rotation of glass envelope 102 about at least axis 202.

Referring to the screen printing process (3), normally associated with printing (using silk or metal mesh) on flat or convex surfaces (such as beverage bottles), it is performed so that it is successfully applied to concave interior surface 116 of glass envelope 102 by using a concentric-shaped flexible screen. The screen is inserted into glass envelope 102, a CL phosphor composition (similar to that used in flat-screen phosphor printing) is measured into glass envelope 102 and is forced through the screen using an inflatable bladder. Once the CL phosphor composition is deposited, the bladder and screen are removed from glass envelope 102. If required or desired, the deposit may be densified by rotation of glass envelope 102 about axis 202 and, in some embodiments, about axis 204.

The photopolymerization resin process (4) is performed by pouring a measured amount of a photo resin that includes CL phosphor into glass envelope 102 and then photo-printing desired regions through the transparent glass from outside of glass envelope 102. The physical location of the exposure may be controlled by externally masking glass envelope 102 or projecting exposure light on appropriate areas where phosphor is desired. The thickness of CL phosphor deposit is determined by judiciously controlling the wavelength of an exposure radiation utilized for photo-printing, as well as the duration of the exposure. Following exposure, the photo resin is developed by standard techniques, leaving a substantially uniformly-thick and properly-positioned deposit. If required or desired, the deposit may be densified by rotation of glass envelope 102 about axis 202 or by another densification technique.

The above-described processes (1-4) may each also utilize internal masking to control where CL phosphor 104 is deposited. Internal masking of glass envelope 102 may, for example, provide improved efficacy of CLPL 100 and/or the ability to create luminous patterns or effects.

CL phosphor 104 is deposited substantially uniformly, positioned properly, and has the desired density for efficient operation of CLPL 100. Densification of CL phosphor 104 allows maximal heat transfer from CL phosphor 104 (resulting from the CL process) to the exterior of CLPL 100, to provide heat dissipation through glass envelope 102. Proper heat dissipation advantageously assures minimal degradation and improved efficacy of CL phosphor 104 during operation of CLPL 100. As dissociation ruins the ability of CL phosphor 104 to luminesce, minimal dissociation improves longevity of CL phosphor 104 and operation of CLPL 100. These degradation and dissociation processes are sometimes referred to as aging of the phosphor by the CRT community.

In an alternate embodiment, CL phosphor 104 may be electrophoretically-deposited (5) in order to maximize the density of CL phosphor 104 and thus maximize heat transfer from CL phosphor 104 during excitation without need of further densification. The electrophoretic deposition methods are configured so that (a) deposition occurs only at the desired physical locations within glass envelope 102, (b) the correct thickness of CL phosphor 104 is obtained for CLPL 100, and (c) deposited CL phosphor 104 has an optimal density for maximal CL phosphor lifetime and improved efficacy during operation of CLPL 100.

In one method of electrophoretic-deposition, a transparent, conductive layer (not shown) is first deposited onto surface 116 of glass envelope 102. A phosphor slurry including at least a binder, electrolyte, and one or more CL phosphors is then applied to surface 116 of glass envelope 102. A positive electrode is inserted into the phosphor slurry and the transparent conductive layer is used as a cathode such that CL phosphor 104 is deposited onto the transparent conductive layer.

In another method of electrophoretic-deposition, a phosphor slurry including a silicate binder and CL phosphor is applied to surface 116 of glass envelope 102. An electric field is created by having a first electrode on an exterior surface 117 of glass envelope 102 and a second electrode within glass envelope 102, such that the electric field is AC coupled through glass envelope 102 The resultant CL phosphor deposit may be post-processed by lacquering and aluminization, if desired.

Base Assembly

Power supply 114 of base assembly 112 may be sized so as to be contained within base assembly 112, which in some embodiments fits into a standard GL lighting-fixture socket (with electrical isolation) and in some embodiments fits other sockets, is configured to provide the following features: (1) generation of electrical signals that warm a thermionic cathode of electron gun assembly 106, thereby exciting electrons and cause emission from electron gun assembly 106 within CLPL 100, (2) provision of high potential differences between cathode and anode to accelerate the emitted electrons (e.g., electrons 109) to a total energy appropriate to cause CL phosphor 104 to luminesce at levels of brightness associated with GL requirements (e.g., 50-80,000 Cd/m$^2$), and (3) isolation of high and low voltages used within CLPL 100 such that exposed exterior surfaces of CLPL 100, when fitted into a standard GL lighting fixture socket, are electrically-grounded and such that the glass (e.g., glass envelope 102) at all exterior surfaces of CLPL 100 has no significant electric field across it.

Figure 3:
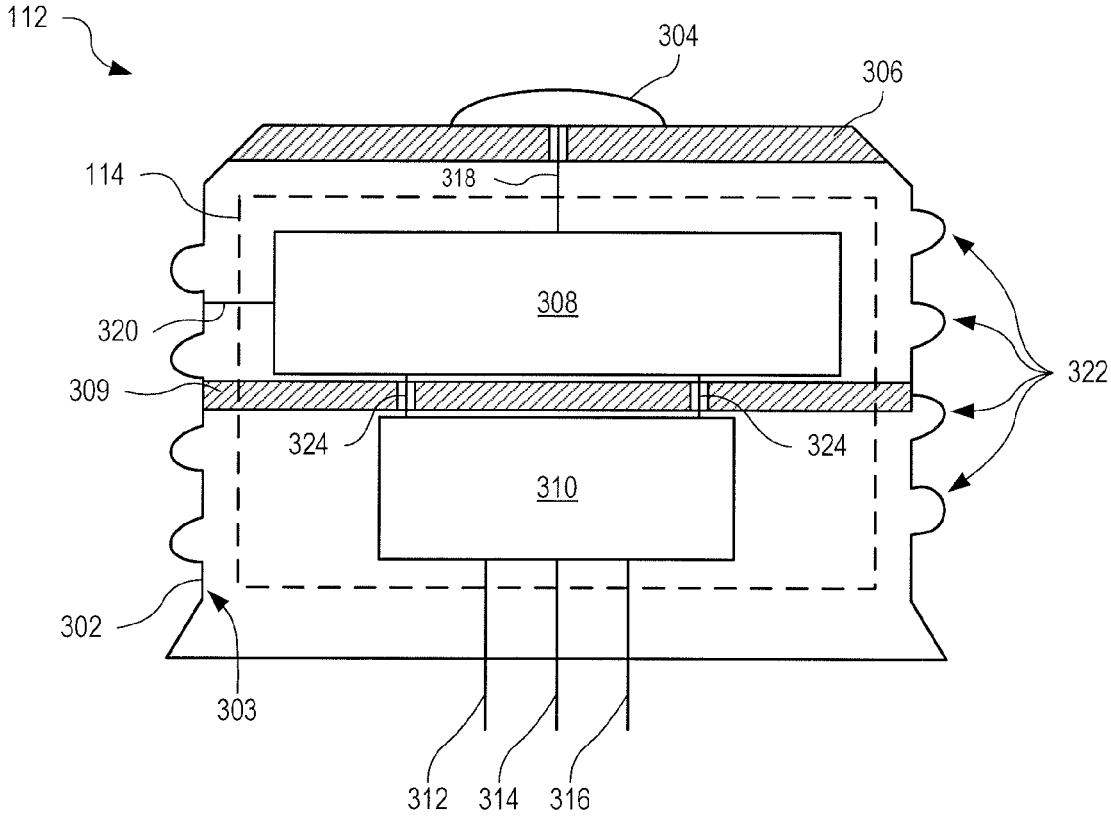
FIG. 3 shows a cross sectional embodiment through the base section of FIG. 1.

FIG. 3 shows a cross sectional embodiment through base section 112 of FIG. 1. Base section 112 has a shell 302 that forms a first exterior conductive surface that is insulated from a second exterior conductive surface 304 by a first insulator 306. Shell 302 is cylindrically symmetric and is threaded 322 to fit in this embodiment a standard "Edisonian" light fixture, in this example; in particular, the threads on the side of shell 302 connect to the neutral ac power within the light fixture. As shown, shell 302 has an insulating interior surface 303 and contains a power supply 114 appropriate to adapt a standard AC supply into electrical signals suitable for operating CLPL 100. Power supply 114 includes an ac-level circuit 308 and a high-voltage (pulse and dc) circuit 310 that are isolated from each other (except for desired electrical connections 324) by a second insulator 309. Electrical connections 324 may convey power from ac-level circuit 308 to high-voltage circuit 310. High-voltage circuit 310 is shown with three electrical signal wires 312, 314 and 316, that connect with other components within glass envelope 102. The electrical signals conveyed by these wires control a heater (see heater 424, FIG. 4) to heat emissive cathode surface of an electron gun assembly 106, FIG. 1, and to bias CL phosphor 104 and electron gun 106 such that an appropriate energy level and current density of electrons delivered to CL phosphor 104 are suitable for GL illumination.

In the embodiment of FIG. 3, power supply 114 is typically exterior to vacuum contained within glass envelope 102. Base unit 112 physically couples to glass envelope 102 (and its attached thermionic cathode electron gun assembly 106) and is sealed around its perimeter to prevent shock to the user. The size of base unit 112 is, for example, correct for connection within an Edisonian socket of a lighting fixture; but it may be larger for inclusion of more sophisticated electronics within power supply 114 (e.g., power supply 114 may be larger to include additional circuitry for generating additional voltages within CLPL 100). Shell 302 may also have a cylindrical insulating extension (not shown) that forms an extended enclosure between base assembly 112 and glass envelope 102, to accommodate additional circuitry.

In the illustrated embodiment of FIG. 3, power supply 114 (and in particular ac-level circuit 308) operate with standard voltage level and frequency (typically, worldwide, either 120V 60 Hz or 220V 50 Hz). Insulator 309 is formed as a circular dielectric that attaches to the interior of shell 302 to electrically and physically separate ac-level circuit 308 from high (low)-voltage circuit 310 (except for required electrical feed-through vias between the two circuits). Insulator 309 may also serve as an insulating attachment substrate for circuits 308 and 310.

Figure 4:
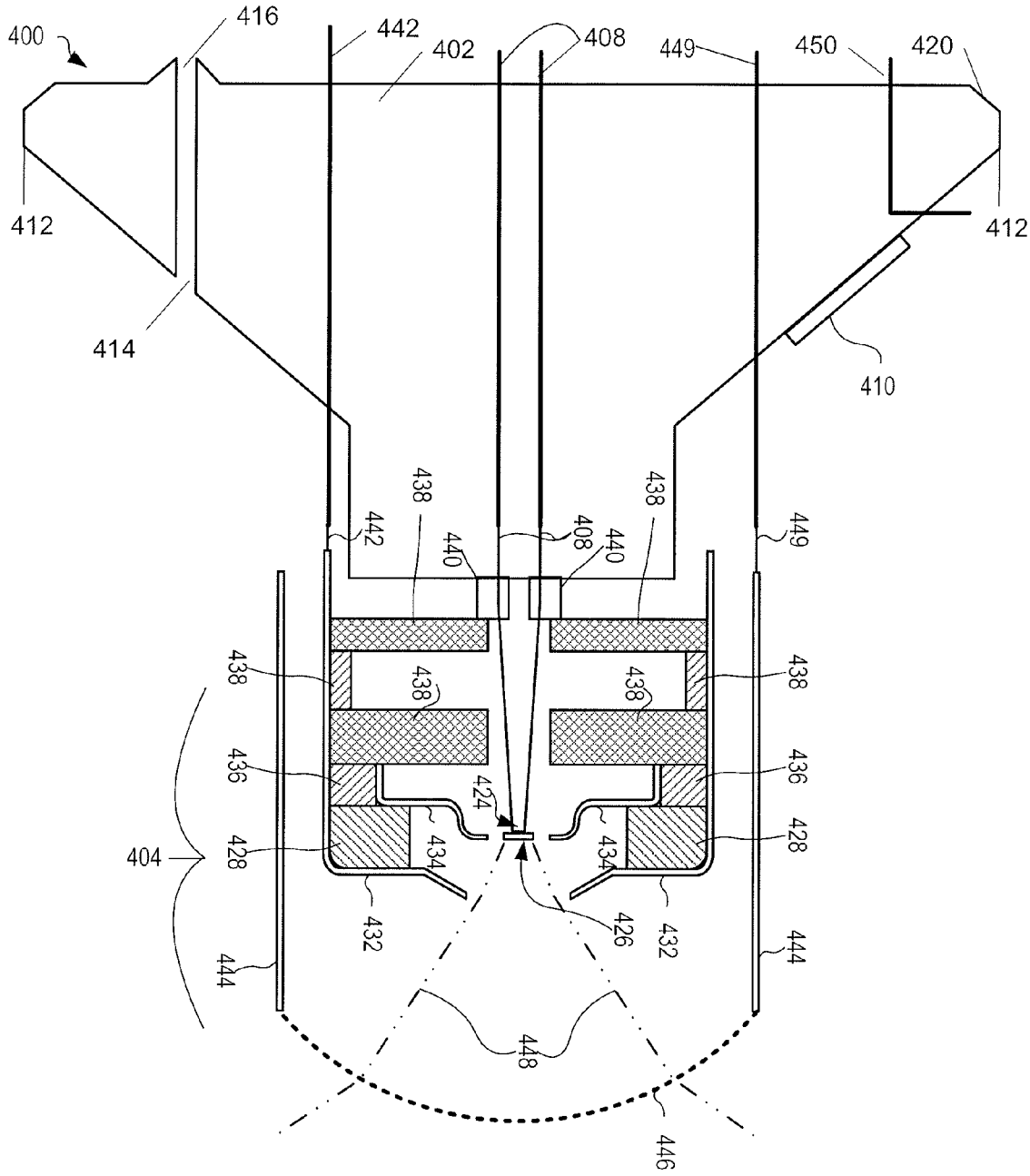
FIG. 4 is a cross sectional embodiment showing exemplary detail of a directly-heated electron gun assembly of FIG. 1.

FIG. 4 is a cross section showing exemplary detail of electron gun assembly 106 of FIG. 1. In particular, thermionic cathode electron gun assembly 106 has a glass pump-stem 402, a thermionic-cathode electron gun 404, electrical feedthroughs 408 and a vacuum getter 410.

Glass pump-stem 402 may be made of silicate glass (or other material) compatible with attachment to glass envelope 102, FIG. 1. Glass pump-stem 402 is shown with a glass vacuum tubulation 414 that allows evacuation and sealing (at a pinch point 416) of glass envelope 102 once assembled (e.g., at surfaces 412) together with glass pump-stem 402. As shown in FIG. 4, glass pump-stem 402 forms a substrate upon which gun 404, electrical feedthroughs 408 and a vacuum getter 410 are attached. Glass pump-stem 402 may also provide attachment (e.g., at surfaces 420) to base assembly 112.

In the example of FIG. 4, thermionic-cathode electron gun 404 has a heating element 424 and emissive cathode surface 426. Gun 404 may also include any necessary dielectric standoffs (to prevent electrical short-circuiting, and/or proper mounting within the overall device), such as standoffs 428 and electrical connectivity to facilitate connection of heating element 424 and emissive cathode surface 426 (e.g., via feedthroughs 408).

In one embodiment, heating element 424 is a 'bent wire' with the disc of emissive cathode surface 426 attached at the bend. Emissive cathode surface 426 is for example made from a conductive metal coated with barium-carbonate which becomes barium-oxide when under vacuum or other emissive oxide coating as known in the art of thermionic cathodes.

Some of feedthroughs 408 connects to heating element 424 to provide electrical power in the form of current that heats the cathode, including emissive cathode surface 426. Current through heating element 424 is controlled to maintain emissive surface 426 of the cathode at a desired temperature. Heating element 424 is for example made from a tungsten alloy, such as one of Tungsten-Rhenium. Heating element 424 may be formed as a coil to concentrate heat applied to cathode emissive surface 426. Since heating element 424 is electrically connected to cathode emissive surface 426, the electric potential of emissive surface 426 is controlled by the voltages applied to the associated feedthroughs 408.

An extraction grid and support 432 is formed with a hole through which electrons may be emitted towards the anode. Extraction support 432 is for example made from a conductive metal or metal alloy that has sufficient strength at high temperatures. A suppressor grid 434 is held centrally within extraction support 432 by insulating spacer 436 and positioned a certain distance from extraction grid 432 by insulating spacer 428. Suppressor grid 434 surrounds the cathode; in some embodiments suppressor grid 434 is electrically connected to the cathode and in other embodiments it is isolated from the cathode. Insulating spacers 436 and 428, which may be a single spacer, are made from a suitable high-temperature insulator such as a ceramic compound or a mineral such as mica. The cathode's emissive surface is partially shielded by suppressor grid 434 to reduce electron flux incident on those parts of the envelope not coated with phosphor and incident on the extraction grid/support 432. Insulating spacers 428, 436 and 438 provide depth control for the cathode. Cathode support 440 is welded to feedthroughs 408. The cathode is positioned centrally within extraction support 432 and such that emissive surface 426 of cathode is a predetermined distance of 0.068 inches to 0.084 inches from extraction grid/support 432. Extraction grid/support 432 is conductive and connects to a feedthrough 442 such that a desired electrical potential may be applied to it via feedthrough 442. A diffusing grid support 444 is formed around extraction support 432, and in some embodiments in contact with extraction support 432, and has a diffusing grid 446 mounted at one end. Diffusing grid 446 is convex with respect to cathode 426 and operates to diffuse an electron beam 448 emitted from cathode.

In an embodiment, before assembly of the electron gun 404, the tubular diffusing grid support 444 is welded to a screen mesh, the screen mesh is then formed into a dome shape by forcing a tool through diffusing grid support 444 to push the mesh into a dome shape, becoming domed diffusing grid 446.

In one embodiment, feedthroughs 408, 442 and 450 are made of a conductive alloy with the same rate of expansion as the glass through which they pass. For example, feedthroughs 408, 442 and 450 may pass through glass stem 402 that positions electron gun assembly 400 within evacuated glass bulb 102, FIG. 1.

In one example of operation, a current is passed though electrodes 408 and heating element 424, causing heating element 424 to heat cathode emissive surface 426. Electrodes 408 is offset by a negative potential which imparts a negative potential to emitting surface 426. Extraction grid/support 432 is held at a positive potential relative to cathode emitting surface 426 via electrode 442, thereby extracting electrons from emissive surface 426. These electrons, shown as electron beam 448, pass through extraction grid/support 432 and are accelerated by a positive potential relative to the cathode emitting surface 426 applied to diffusing grid 446 via feedthrough 449. In an embodiment, diffusing grid 446 and extraction grid/support 432 are electrically tied together.

Gun 404 attaches to the end of glass pump-stem 402 such that electron gun 404 is directed towards CL phosphor 104 within glass envelope 102, as shown in FIG. 1, once glass envelope 102 and glass pump-stem 402 are assembled. During operation of CLPL 100, gun 404 emits electrons (e.g., electrons 109, FIG. 1, electron beam 448, FIG. 4) with an energy level and current value appropriate for efficacious illumination of CL phosphor 104 (e.g., typically 50-300 $mW/cm^2$ striking the phosphor area). In an embodiment, gun 404 excites CL phosphor 104 at levels appropriate for GL lamps, with a lower excitation level associated with minimal efficacious operation of CL phosphor 104 and an upper excitation level associated with the onset of excessive x-ray generation by high energy electrons impacting CL phosphor 104, anode conductors, and the envelope 102.

Electrical feedthroughs 408, 442, 449, and 450 provide electrical connectivity between power supply 114 and gun 404 and CL phosphor 104 (e.g., via feedthrough 450 and conductive coating 206) and mechanical support for the electron gun 404. Specifically, electrical feedthroughs 408 provide connectivity between power supply 114 and heater 424. Further, electrical feedthroughs 408 have a similar thermal expansion rate to the material of glass pump-stem 402 to maintain vacuum-sealing of glass envelope 102. Specifically, electrical feedthroughs 408 provide connectivity between power supply 114 and electron gun 106, CL phosphor 104 and heater 418. Glass pump-stem 402 may have more or fewer electrical feedthroughs (e.g., more to provide connectivity to one or more of an extraction grid, a focus grid and a resistive getter, and/or to provide additional control of heater 424 or fewer where emissive cathode 426 and heater 424 share connectivity) without departing from the scope hereof. Electrical feedthroughs 408, 409, 442, and 450 may also be used to provide mechanical support for gun 404 and/or getter 410 as a matter of design choice.

Getter 410 may represent one or more passive and/or active getter materials used to absorb oxygen and help create and/or maintain a suitable vacuum within glass envelope 102 (i.e., once glass envelope 102 and glass pump-stem 402 are assembled and sealed). In one example, getter 410 represents one or more of an inductively-activated barium flash getter, a resistive getter, chemical getter and any other component that helps maintain sufficient vacuum within CLPL 100.

Thermionic-cathode electron gun 404 may also be formed using an indirectly heated cathode, which may, but need not be, electrically isolated from heater 424, without departing from the scope hereof.

Figure 5:
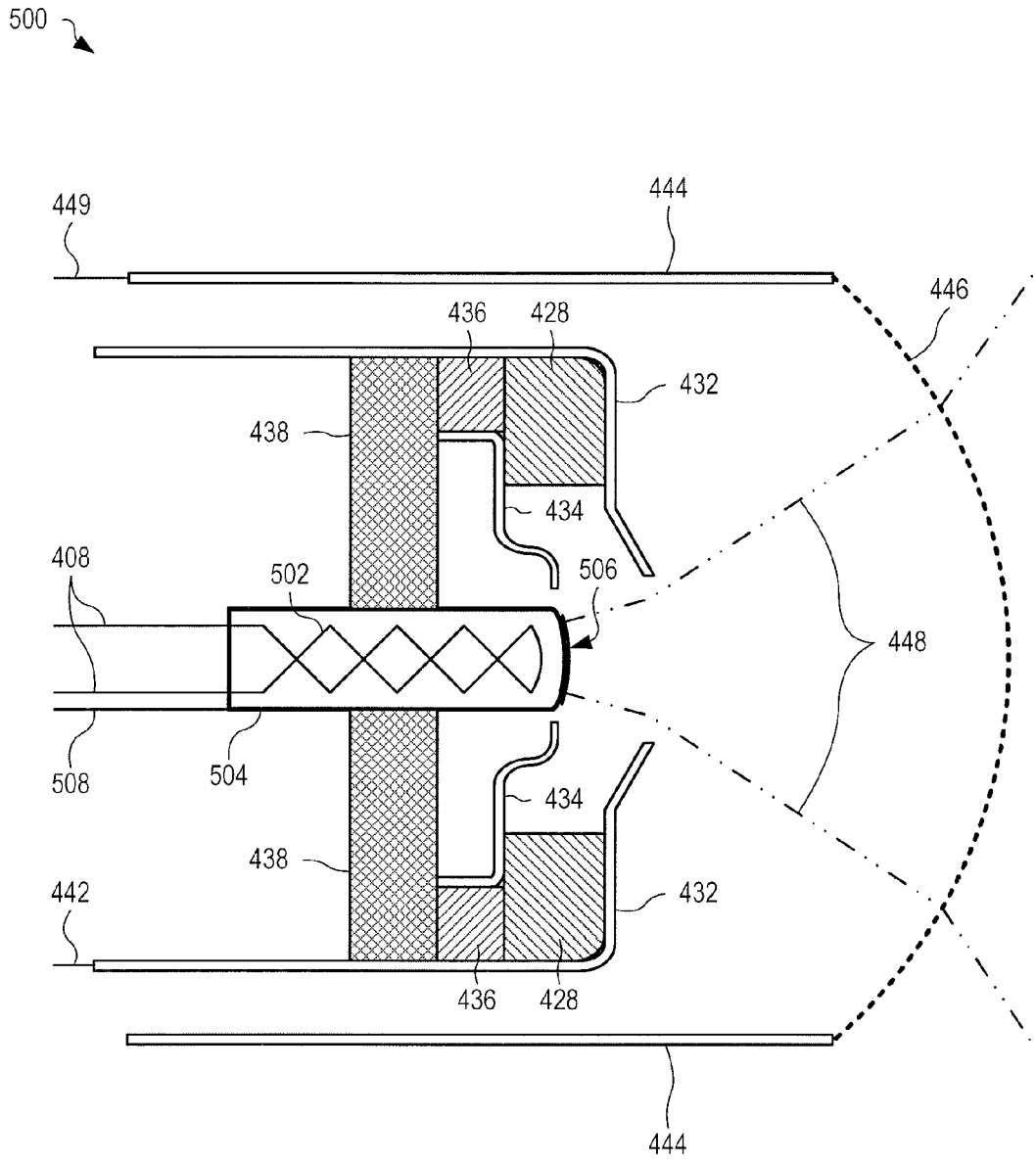
FIG. 5 shows an alternative embodiment of the electron gun of the electron gun assembly of FIG. 1 having an indirectly heated cathode.

The alternative embodiment of FIG. 5 is an embodiment having such an indirectly heated cathode. In this alternative embodiment of electron gun 500, feedthroughs 408 connect to a resistive heater 502. The heater 502 is formed of tungsten wire similar to the heater 424 of FIG. 4, but instead of forming a hairpin shape as in FIG. 4, it is coiled within, and insulated by ceramic from, a conductive metallic cylindrical cup 504. A base 506 of cup 504 is coated with a thermionic emissive material such as barium oxide and acts as cathode of the electron gun 500. Cylindrical cup 504 is electrically connected to a most-negative terminal of the power supply by a feedthrough 508.

Figure 5A:
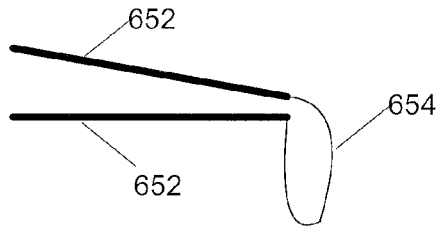
FIG. 5A illustrates an alternative, directly-heated, cathode that may be used in the electron gun assembly.

FIG. 5A illustrates an alternative embodiment of directly heated filament thermionic cathode that may be substituted for the heater 424 and emissive surface 426 in an embodiment otherwise resembling that of FIG. 4. In this embodiment, two wires 652, typically extensions of feedthroughs 408, serve to conduct power to, and support, a resistive wire loop 654. Resistive wire loop is preferably coated in barium oxide, or another material known for good thermionic emissive qualities, and is fabricated from a material having good high temperature strength such as a tungsten or tungsten alloy.

The Power Supply

High voltage circuit 310, FIG. 3, has at least a DC acceleration circuit to generate and maintain a high potential difference between the emissive cathode surface 426, FIG. 4, of the electron gun 404 and the cathodoluminescent phosphor layer (e.g., CL phosphor 104, FIG. 1), and to provide suitable voltages to the extraction grid/support 432.

The DC acceleration circuit has an AC to DC converter that generates a DC output voltage between 5 KV and 30 KV, for biasing the cathodoluminescent phosphor layer positive with respect to the cathode, and to provide suitable voltages to heater 424, extraction grid/support 432 and diffuser mesh 446. The power output of high-voltage circuit 310 is between 50 mW and 100 W, although higher output power may be used for large lamps without departing from the scope hereof. The DC acceleration circuit maintains an electric field between the emissive cathode surface 426, 506 of electron gun assembly 106 and CL phosphor 104 to accelerate electrons generated by electron gun assembly 106 toward CL phosphor 104.

In an embodiment, power supply 114 generates an AC and/or DC supply for heater 502 and generates a DC voltage for extracting and defocusing grids 432, 446 included in gun 500. Additional electrical feedthroughs may be included within glass pump-stem 402 if needed.

Figure 6:
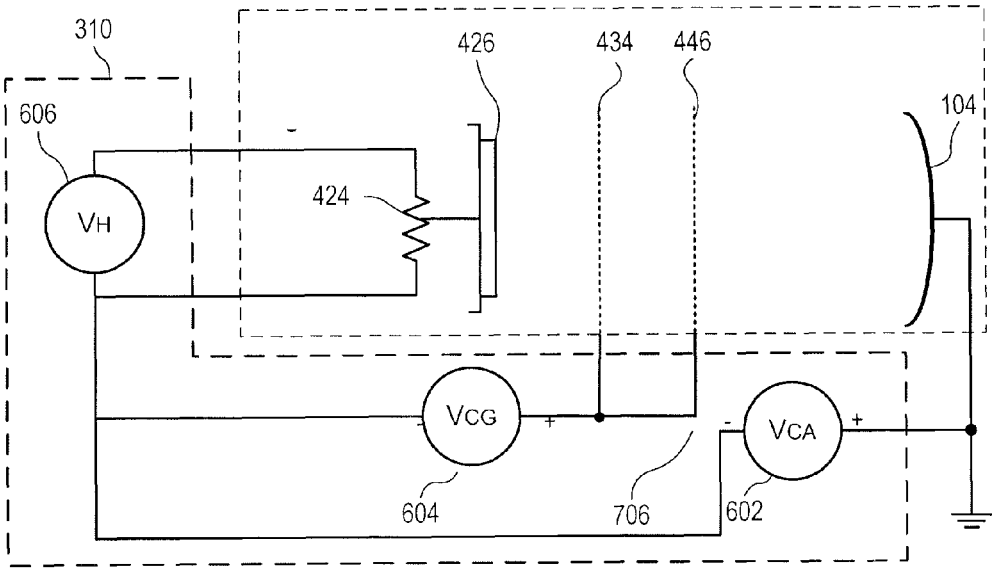
FIG. 6 shows an exemplary circuit for powering both the emissive cathode surface and the heater of the CLPL of FIG. 1 using the electron gun assembly of FIG. 4.

FIG. 6 shows an exemplary circuit 600 for powering both emissive cathode surface 426 and heater 424 of electron gun 404, FIG. 4. Circuit 600 has DC power supply 602 for applying a high voltage between the emissive cathode surface 426 of electron gun 404 and CL anode 104. A second supply 604 is provided for biasing extraction 432 and diffusing 446 grids, which may be a pulsed supply in dimmable embodiments, or may be a DC supply. In an alternative embodiment, second supply 604 is replaced by a resistor, which permits secondary emission of electrons from these grids to bias these grids positive with respect to the cathode. Heater 424 is connected across a third power supply element 606. In this example, heater 424 provides the direct electrical contact to, and physical substrate for, emissive cathode surface 426. In an alternative embodiment, heater 424 is directly coated with thermionic emissive material and serves as cathode emissive surface 426.

Current through emissive cathode surface 426 (i.e., thermionically-emitted to CL phosphor 104) is substantially less than current through heater 424 and therefore current through emissive cathode surface 426 does not measurably affect operation of heater 424.

By combining heater 424 and emissive cathode surface 426, the design of CLPL 100 may be simplified, manufacturing cost may be reduced and reliability may be increased.

Figure 7:
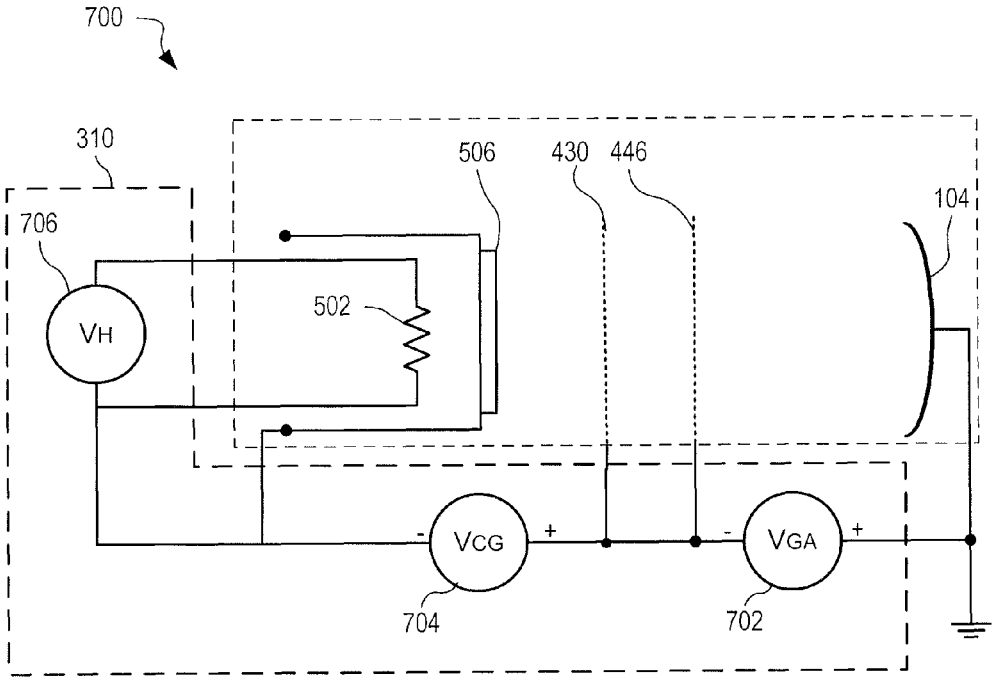
FIG. 7 shows an alternative circuit that represents an embodiment of the CLPL of FIG. 1 using the electron gun of FIG. 5.

FIG. 7 shows another exemplary circuit 700 that represents an embodiment of CLPL 100, FIG. 1, with an extraction grid/support 432 and diffusive grid 446 operating at the same potential. High-voltage circuit 310 has a grid to anode power supply 702, grid to cathode power supply 704 and a heater power supply 706. Grid to anode power supply 702 and grid to cathode power supply 704 are connected in series between emissive cathode surface 506 and the CL anode 104.

Extraction grid/support 432 accelerates electrons emitted from emissive cathode surface 506 and starts them on the way through the defocusing grid. Once past the defocusing grid, the cathode to anode potential accelerates them sufficient to stimulate radiation emission by CL phosphor 104. Additional power supplies may be included within high-voltage circuit 310 and utilized for other applications, such as to drive thermionic-cathode gun 404 in tetrode or pentode configuration by including additional grids.

In an embodiment, the grids are maintained at a voltage about fifty to one hundred fifty volts positive with respect to the emissive surface of the electron gun. In an alternative embodiment, the CLPL is dimmed by circuitry in the power supply pulse-width modulating a voltage on one or both grids, the pulses switching the voltage on the grids from approximately zero to a voltage between fifty and one hundred fifty volts positive, the grid voltages measured relative to the emissive surface of the cathode. In yet another alternative embodiment, the CLPL is dimmed by circuitry in the power supply adjusting a voltage difference between at least one of grids 432 and 446, preferably extraction grid/support 432, and the emissive surface 426.

In a particular embodiment of CLPL 100, all external surfaces may be at ground potential, with the exception of connection surfaces 302 and 304 of base assembly 112 that connect to a standard lighting fixture. CLPL 100 utilizes pulse and/or DC power with amplitudes of up to 30 kV Some embodiments disclosed herein have power supplies that generate negative voltages with respect to ground, such that emissive cathode surface 426, 506 has the most negative potential in CLPL 100 and the anode is near or at ground. Since in that embodiment, CLPL 100 is powered using only negative voltages relative to ground, all power supplies (e.g., power supplies 114, 308, 310, 602, 604, 702 and 704) may be electrically isolated within base assembly 112 and within the central-most part of CLPL 100. Isolation and safety may be further increased by encasing each power supply in dielectric material (e.g., non-conductive epoxy) such that only electrical feedthroughs 408, 442, 449 (i.e., wires running directly to gun 404) are exposed. By locating these electrical feedthroughs at the central-most part of CLPL 100 and spacing them furthest from all grounded surfaces, maximal safety and protection from internal arcing (resulting from the use of high voltages) may be achieved. Further, these embodiments provide simple and low-cost designs that maximize reliability and cost-competitiveness.

Process Sequence in Overview

Glass envelope 102, electron gun assembly 106 and base assembly 112 may each be assembled independently. Once assembled, electron gun assembly 106 is aligned and sealed to glass envelope 102. This sealed combination is designed to be of sufficient strength for vacuum-evacuation. The anode of the device is connected to the interior of its associated electrical feed (e.g., electrical feedthrough 450 at a point) by an alignment process of glass envelope 102 and electron gun assembly 106. These combined units may then be baked (for out-gassing) and pumped to a vacuum level appropriate for operation of gun 404; after which, pump-stem tubulation 414 is hot pinch-sealed at point 416 to maintain vacuum within the combined units. Getter 410 may then be activated to preserve vacuum within the interior of the combined units over the usable lifetime of CLPL 100. The exterior connections of electrical feedthroughs 408, 442, 450, are then attached to associated terminals of circuitry within base assembly 112 which is then physically attached, in any physically-tenacious manner, to the combined, vacuum-sealed, glass envelope 102 and electron gun assembly 106.

Figure 8:
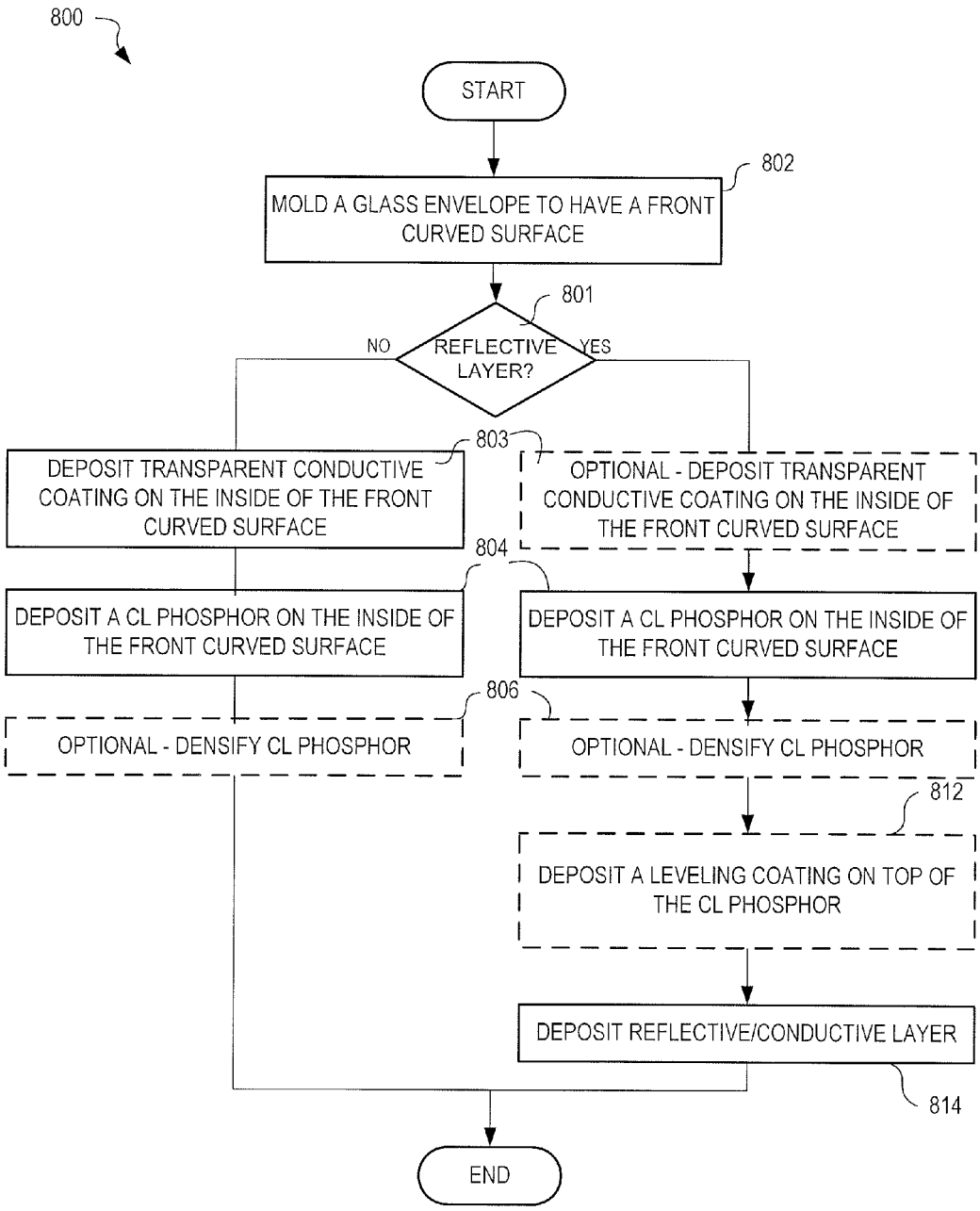
FIG. 8 shows one exemplary process for creating the glass envelope assembly of FIG. 2.

FIG. 8 shows one exemplary process 800 for creating glass envelope assembly 200 of FIG. 2. In step 802, process 800 molds a glass envelope to have a front surface. In one example of step 802, glass envelope 102 is molded to have front surface 116 and to conform to standard GL fixture shapes.

Step 801 is a decision whether a reflective layer is to be included.

Step 803 is required if no reflective layer is to be applied and the phosphor layer is nonconductive, or if the phosphor is to be deposited electrophoretically; otherwise it is optional. In this step, a transparent conductive layer, such as tin oxide or indium tin oxide, is applied to the inside surface of the front surface 116 of the envelope 102.

In step 804, process 800 deposits a CL phosphor layer on the inside of the front surface formed in step 802. In one example of step 804, CL phosphor 104 is deposited upon front surface 116 by one or more of: settling, spin-coating, screen printing, photo-activated resin printing and electrophoretic deposition.

Step 806 is optional, it is typically omitted if the CL phosphor is electrophoretically deposited, and may be used if the phosphor is deposited using one of the other methods discussed herein. In step 806, process 800 densifies the CL phosphor. In one example of step 806, glass envelope assembly 200 is rotated about axis 202 such that particles of CL phosphor within CL phosphor 104 migrate towards front surface 116.

If a reflective layer is to be included, process 800 continues with deposition 812 of a leveling coating; followed by deposition 814 of the reflective layer. Otherwise, process 800 may terminate.

In step 812, process 800 deposits a leveling layer onto the CL phosphor layer. In one example of step 812, a lacquer layer is deposited onto CL phosphor layer 104 such that the following reflective layer becomes specular, and such that the reflective layer does not excessively diffuse into the CL phosphor layer 104.

In step 814, process 800 deposits a reflective layer into areas of the glass envelope not covered by CL phosphor. In one example of step 814, reflective layer 208 is deposited onto internal surfaces of glass envelope 102 not covered by CL phosphor 104. In another example of step 814, reflective layer 208 is deposited onto CL phosphor layer 104 and internal surfaces of glass envelope 102 not covered by CL phosphor 104 and forms a conductive layer.

Figure 9:
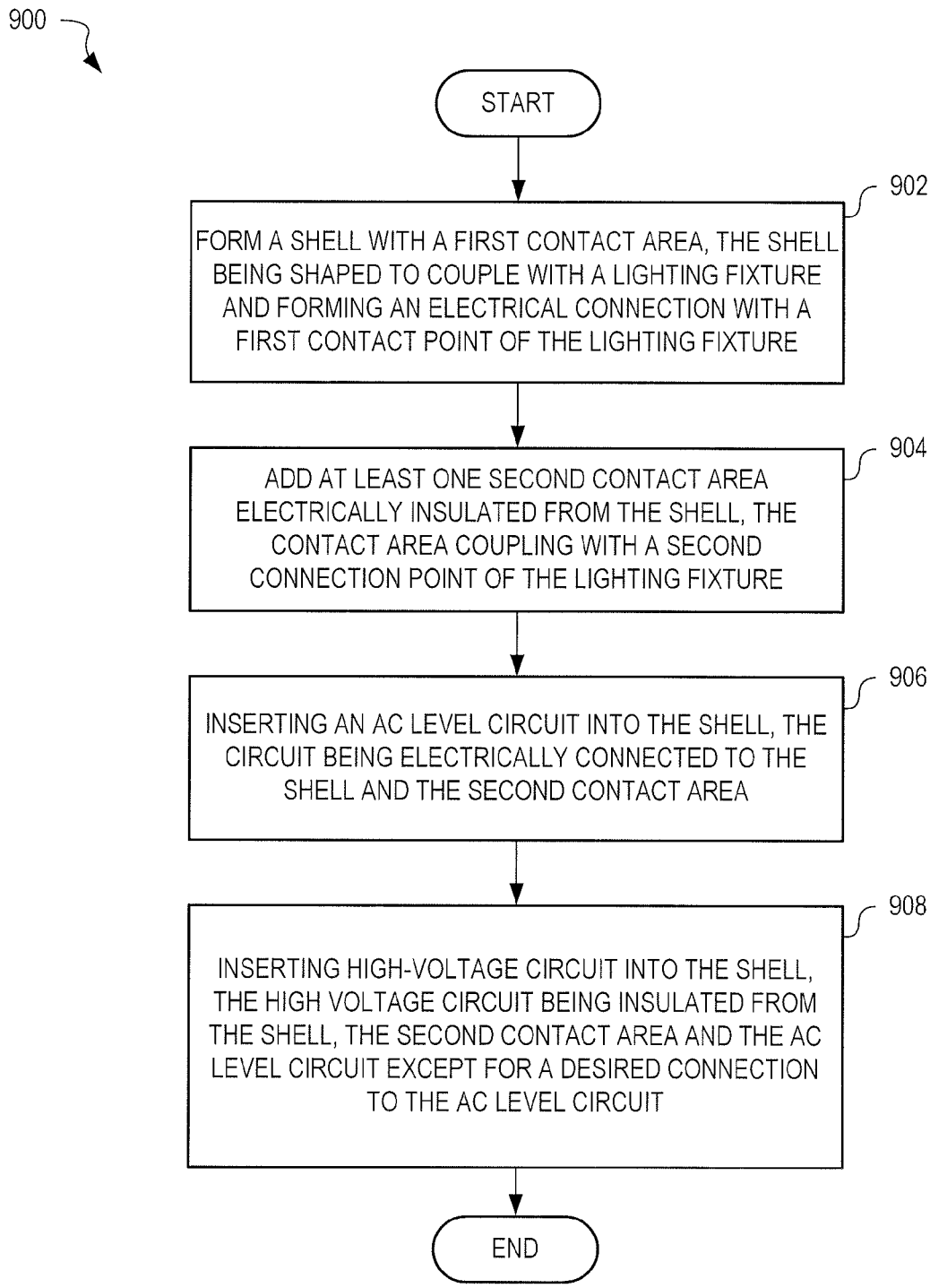
FIG. 9 shows one exemplary process for forming the base assembly of the CLPL of FIG. 1.

FIG. 9 shows one exemplary process for forming base assembly 112 of CLPL 100, FIG. 1. In step 902, process 900 forms a shell with a first contact area, the shell being shaped to couple with a lighting fixture and forming an electrical connection with a first contact point of the lighting fixture. In one example of step 902, shell 302 is made of metal and formed with screw thread 322 such that shell 302 fits a standard "Edisonian" light fixture and couples with the outer neutral (i.e., not hot) electrical connection of the fixture.

In step 904, process 900 adds at least one second contact area electrically insulated from the shell, the contact area coupling with a second connection point of the lighting fixture. In one example of step 904, second exterior conductive surface 304 is added to shell 302, and is insulated from shell 302 by first insulator 306, such that second exterior conductive surface 304 makes electrical contact with the live (i.e., hot) electrical central contact point of the standard "Edisonian" light fixture.

In step 906, process 900 inserts an AC level circuit into the shell, the circuit being electrically connected to the shell and the second contact area. In one example of step 906, AC level circuit 308 is inserted into shell 302 such that only desired electrical connectivity 320, 318 is made between shell 302, second external contact surface 304 and AC level circuit 308, respectively In step 908, process 900 inserts the high-voltage circuit into the shell, the high voltage circuit being insulated from the shell, the second contact area and the AC level circuit except for desired connections to the AC level circuit, the high-voltage circuit having suitable outputs for driving the cathodoluminescent tube. In one example of step 908, high voltage circuit 310 is inserted into shell 302 such that circuit 310 makes no electrical contact with shell 302 and external contact surface 304 and only desired contact 324 with AC-level circuit 308.

Figure 10:
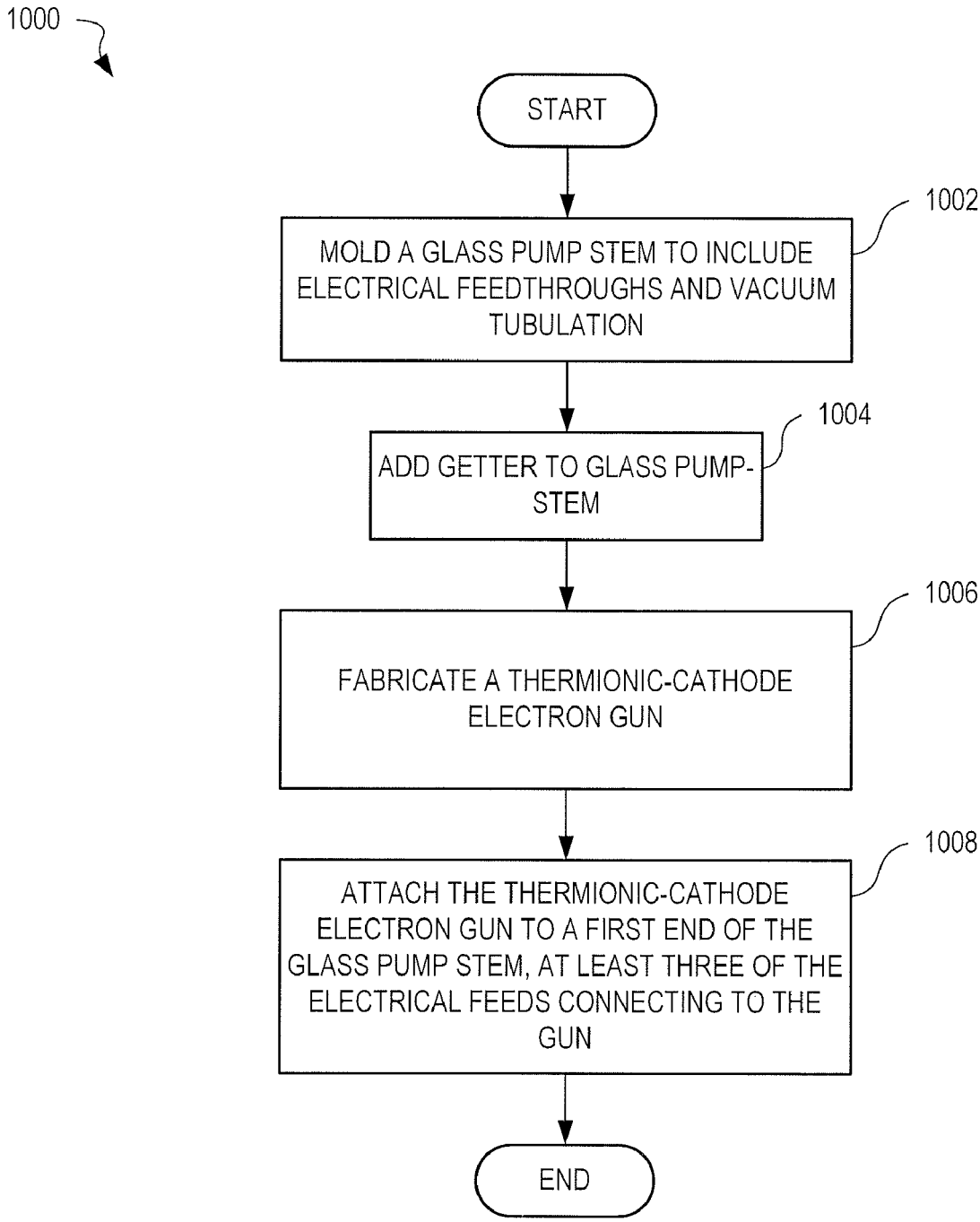
FIG. 10 shows one exemplary process for assembling the thermionic cathode assembly of FIG. 1.

FIG. 10 shows one exemplary process 1000 for assembling electron gun assembly 106 of FIG. 1. In step 1002, process 1000 molds a glass pump stem to include electrical feedthroughs 442, 448, 449, 450 and a vacuum tubulation. In one example of step 1002, glass pump stem 402 is molded with electrical feedthroughs 408 and vacuum tubulation 414.

In step 1004, process 1000 adds at least one getter to the glass pump stem of step 1002. In one example of step 1004, getter 410 is added to glass pump stem 402.

Figure 10A:
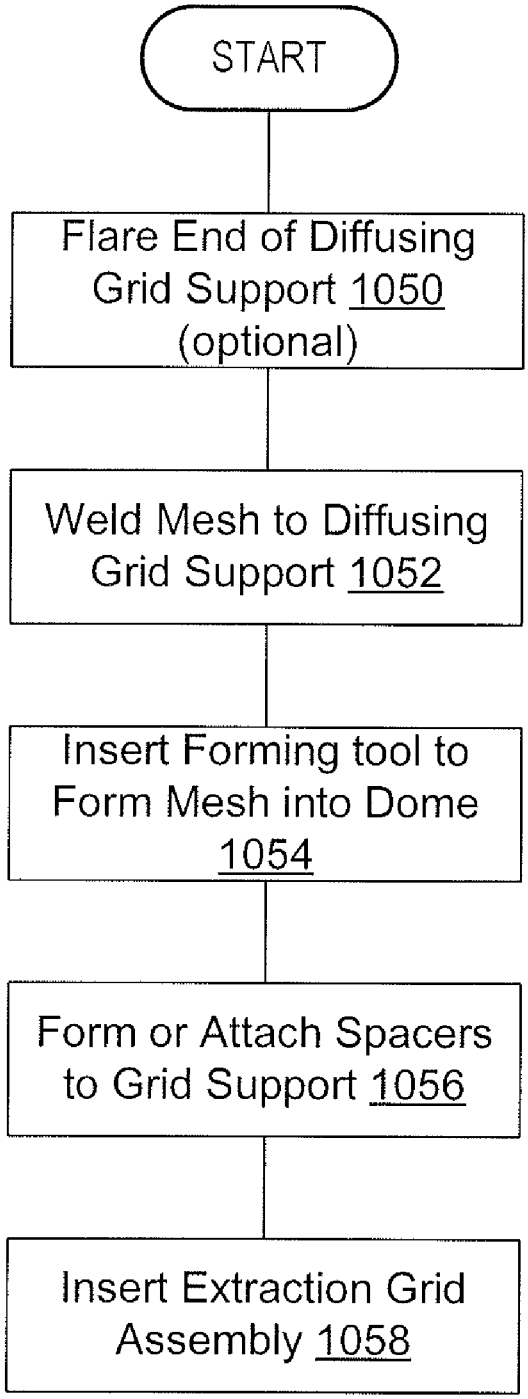
FIG. 10A illustrates a process for manufacturing the dome-shaped diffusing grid of the electron gun assembly.

In step 1006, process 1000 fabricates a thermionic-cathode electron gun to include a metal shroud, a heating element and an emissive cathode surface. Details of fabricating the electron gun are in FIG. 10A. A tubular metallic conductive diffusing grid support 444 may be flared 1050 at what will become its electron-emitting end. A conductive metallic mesh is attached, preferably by welding 1052, to the (optionally flared) end of the diffusing grid support. A forming tool is forced 1054 through the diffusing grid support 444 into the mesh, pressing the mesh into a die, and deforming the mesh into a dome shape, such that the mesh becomes dome-shape diffusing grid 446. In embodiments where the diffusing grid and extraction grid are not electrically connected together, hollow ceramic insulating spacers are then wired 1056 to the inside surfaces of the diffusing grid support 444, and an extraction grid and cathode subassembly is then inserted into the diffusing grid support 444.

Returning to FIG. 10, In step 1008, process 1000 attaches the thermionic-cathode electron gun of step 1006 to a first end of the glass pump stem of step 1002, at least three of the electrical feedthroughs 408, 442, 449 connecting to the gun if a hot cathode is used, and at least two feedthroughs 408, 442, 449 if a cold cathode is used. In one example of step 1008, thermionic-cathode electron gun 404 is attached to glass pump stem 402 such that certain of electrical feedthroughs 408, 442, 449 connect to electron gun 404.

Figure 11:
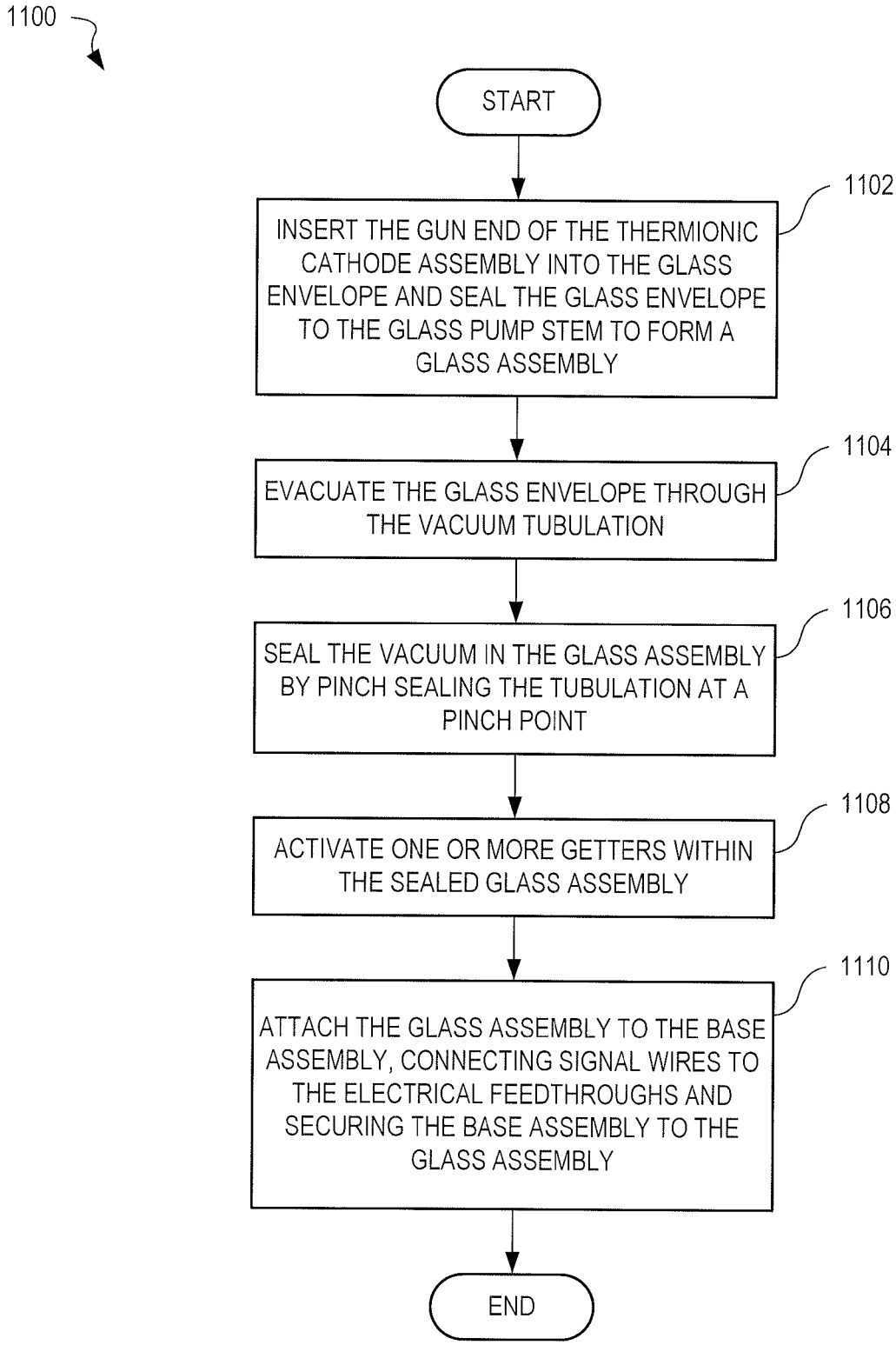
FIG. 11 shows one exemplary process for assembling a glass assembly that includes the glass envelope assembly of FIG. 8 and the thermionic cathode assembly of FIG. 9.

FIG. 11 shows one exemplary process 1100 for assembly of a glass assembly that includes the glass envelope assembly created by process 800, FIG. 8 and the thermionic cathode assembly created by process 1000, FIG. 10.

In step 1102, process 1100 inserts the gun end of the thermionic cathode assembly created by process 1000 into the glass envelope assembly created by process 800 and seals the glass envelope to the glass pump stem to form the glass assembly. In one example of step 1102, electron gun assembly 106 is inserted into glass envelope assembly 200 and glass envelope 102 and glass pump stem 402 are sealed together to support a vacuum therein.

In step 1104, process 1100 evacuates the glass envelope through the vacuum tubulation. In one example of step 1104, glass assembly formed by combining electron gun assembly 106 and glass envelope assembly 200 is evacuated using a vacuum pump applied to vacuum tubulation 414.

In step 1106, process 1100 seals the vacuum in the glass assembly by pinch sealing the tubulation at a pinch point. In one example of step 1106, the vacuum is sealed within the glass assembly formed by combining thermionic cathode assembly 106 and glass envelope assembly 200 by pinch sealing vacuum tubulation 414 at pinch point 416.

Step 1108 is required if the getter is of a type requiring activation. In step 1108, process 1100 activates one or more getters within the glass assembly. In one example of step 1108, getter 410 is activated to create and/or maintain the vacuum within the glass assembly formed by combining electron gun assembly 106 and glass envelope assembly 200.

In step 1110, process 1100 forms the light emitting device by attaching the glass assembly to the base assembly, connecting signal wires to the electrical feedthroughs and securing the base assembly to the glass assembly using an appropriate means. In one example of step 1110, electrical feedthroughs 408 are connected to the signal wires emanating from base assembly 112 and the vacated glass assembly formed by combining electron gun assembly 106 and glass envelope assembly 200 is attached to base assembly 112 in a physically-tenacious manner.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. A light emitting device, comprising:

a glass envelope with a front surface;

a cathodoluminescent (CL) phosphor coating applied to the interior of the front surface, and having a conductive layer adjacent thereto;

a conductive coating within the glass envelope and contacting the CL phosphor and at least part of the internal surface of the glass envelope;

an electron gun assembly further comprising:

a cathode comprising a thermionic emissive surface a conductive suppressor surrounding the cathode for suppressing lateral emission from the emissive surface;

a diffusing grid, and an extraction grid;

a base assembly suitable for coupling with a standard lighting fixture; and a power supply coupled to receive power from the base assembly and wherein the power supply is configured to provide a voltage between the emissive surface of the cathode and the CL phosphor with the CL phosphor relatively positive to the emissive surface, and a voltage between the emissive surface of the cathode and the extraction grid with the extraction grid relatively positive to the emissive surface; and wherein the voltages provided by the power supply causes electrons to be emitted from the electron gun assembly towards the CL phosphor such that the CL phosphor luminesces and light is emitted through the front surface.

2. The light emitting device of claim 1, the electron gun assembly comprising a glass pump stem, and the emissive surface is of the direct-heated cathode type.

3. The light emitting device of claim 1, wherein the power supply provides a voltage to the emissive surface of the electron gun that is negative with respect to ground.

4. The light emitting device of claim 1, wherein the conductive coating is a reflective, conductive, metal.

5. The light emitting device of claim 4, wherein the conductive coating comprises metallic aluminum is approximately 0.07 microns thick in areas adjacent to the CL phosphor.

6. The light emitting device of claim 1, wherein the emissive surface is a thermionic emissive surface in the form of a disk directly attached to a heater, and wherein the power supply provides electrical power to heat the heater.

7. The light emitting device of claim 1, wherein the emissive surface is a directly heated filament.

8. The light emitting device of claim 1 wherein the conductive coating is a transparent conductive coating disposed between the cathodoluminescent phosphor and the internal surface of the envelope.

9. The light emitting device of claim 1 wherein the cathodoluminescent phosphor coating is of a density greater than that produced by settling alone, and within a range producible by settling followed by densification after deposition.

10. The light emitting device of claim 1 wherein the cathodoluminescent phosphor coating is less than twenty microns thick.

11. A light emitting device, comprising:

a glass envelope with a front surface;

a cathodoluminescent (CL) phosphor coating applied to the interior of the front surface;

a conductive coating within the glass envelope and covering the CL phosphor and at least part of the internal surface of the glass envelope not coated by the CL phosphor, the coating having thickness approximately 0.07 microns;

an electron gun assembly having a thermionic emissive surface, an extraction grid, a suppressor for limiting lateral emission from the emissive surface, and a diffusing grid;

a base assembly for coupling with a lighting fixture; and a power supply receiving power from the base assembly and generating at least one power signal for powering the electron gun assembly for applying an acceleration potential between the electron gun and the CL phosphor;

wherein the at least one power signal causes electrons to be emitted from the thermionic emissive surface towards the CL phosphor such that the CL phosphor luminesces and light is emitted through the front surface.

12. A light emitting device comprising:

an electron gun optimized for providing an unfocused source of electrons, the electron gun further comprising a thermionic emissive surface, an extraction grid, and a dome-shaped diffusing grid;

an evacuated envelope having a face, the face of the envelope having a phosphor coating on an inner surface of the face, the phosphor coating having a reflective conductive coating on an inner surface thereof, the phosphor coating and reflective conductive coating together forming an anode;

a power supply for providing an acceleration potential between the emissive surface of the electron gun and the anode, such that the anode is positive with respect to the cathode, and for providing a potential between the extraction grid and the emissive surface of the electron gun such that the extraction grid is positive with respect to the emissive surface; and coupling apparatus for providing power from an external AC source to the power supply;

wherein the extraction grid and the diffusing grid are electrically tied together.

13. The light emitting device of claim 12, wherein the diffusing grid further comprises a metallic conductive mesh attached to a metallic conductive tubular diffusing grid support, and wherein the acceleration potential is greater than five kilovolts.

14. The light emitting device of claim 13, wherein the diffusing grid is welded to the tubular diffusing grid support, and wherein the diffusing grid is formed into a dome by inserting a mandrel through the tubular diffusing grid support.

* * * * *